US006276331B1

(12) United States Patent
Machida et al.

(10) Patent No.: US 6,276,331 B1
(45) Date of Patent: Aug. 21, 2001

(54) METHOD AND APPARATUS FOR FAIL-SAFE CONTROLLING INTERNAL COMBUSTION ENGINE WITH ELECTRONIC CONTROLLED THROTTLE SYSTEM

(75) Inventors: Kenichi Machida, Atsugi; Masahiro Iriyama, Yokohama; Mikio Nozaki, Kamakura, all of (JP)

(73) Assignees: Unisia Jecs Corporation, Kanagawa; Nissan Motor Co., Ltd., Yokohama, both of (JP)

( * ) Notice: Subject to any disclaimer, the term of this patent is extended or adjusted under 35 U.S.C. 154(b) by 0 days.

(21) Appl. No.: 09/368,346

(22) Filed: Aug. 5, 1999

(30) Foreign Application Priority Data

Aug. 5, 1998 (JP) ..... 10-222132
Aug. 5, 1998 (JP) ..... 10-222133

(51) Int. Cl.[7] ..... F02D 9/02
(52) U.S. Cl. ..... 123/396; 123/399
(58) Field of Search ..... 123/396, 399

(56) References Cited

U.S. PATENT DOCUMENTS 5,163,402 * 11/1992 Taguchi et al. ..... 123/399
5,823,164 * 10/1998 Seki et al. ..... 123/399
6,047,679 * 4/2000 Matsumoto et al. ..... 123/396
6,073,610 * 6/2000 Matsumoto et al. ..... 123/396
6,109,239 * 8/2000 Watanabe ..... 123/399
6,116,214 * 9/2000 Ishida ..... 123/399

FOREIGN PATENT DOCUMENTS 7-180570 7/1995 (JP) .

* cited by examiner

*Primary Examiner*—Erick Solis
(74) *Attorney, Agent, or Firm*—McDermott, Will & Emery

(57) ABSTRACT

The apparatus comprises two accelerator position sensors and two throttle position sensors, and when one out of said two accelerator position sensors or said two throttle position sensors fails to operate, a limitation is added to the increase in accelerator position for the output characteristics of the accelerator position sensor. Thereby, the vehicle is enabled to travel at a minimum speed necessary without excessively increasing the engine output. When one of the two throttle position sensors fails to operate, the fuel injection quantity may be set based on the detection value of the accelerator position, which enables the vehicle to be driven by approximately the desired speed without excessively increasing the engine output.

6 Claims, 9 Drawing Sheets

METHOD AND APPARATUS FOR FAIL-SAFE CONTROLLING INTERNAL COMBUSTION ENGINE WITH ELECTRONIC CONTROLLED THROTTLE SYSTEM

BACKGROUND OF THE INVENTION (1) Field of the Invention

The present invention relates to an internal combustion engine equipped with an electronic controlled throttle system for operating a throttle valve equipped in an intake system of the engine to be opened and closed by an actuator to a target position, and more specifically, to a fail-safe control technique in an engine comprising two accelerator position sensors and two throttle position sensors or comprising at least two throttle position sensors, wherein said fail-safe control is performed in case one sensor out of said two sensors fails to operate.

(2) Related Art of the Invention

Conventionally, an electronic controlled throttle system is known where the opening (position) of the throttle valve is electronically controlled based on the accelerator position (step-in quantity of the accelerator pedal) and the engine rotation speed and the like, so as to gain a target air quantity (Japanese Unexamined Patent Publication No. 7-180570).

Of such known electronic controlled throttle systems, the ones that are not equipped with a limp-home structure for mechanically linking the throttle valve by means of the accelerator operation through a wire and the like (full electronic controlled throttle system) are applied, for example, with the following system in case the drive system fails to operate. The system includes two accelerator position sensors and two throttle position sensors, and as for the accelerator position or opening, the smaller value of the two detection values is selected (so as to prevent excessive output), and as for the throttle valve position or opening, the value detected by the main throttle position sensor is used, wherein in some cases, the greater value of the two detection values is selected (the greater value is selected and the value is corrected to a smaller value by a feedback control, thereby preventing excessive output).

According to the fail-safe method in such full electronic controlled throttle system, when one of the two sensors fails to operate (hereinafter called single failure) and the control is switched to utilize only the value detected by the remaining working single sensor, the promptness of failure detection provided by equipping double sensors is lost. Therefore, when the remaining working sensor also breaks down, the change in engine output will become large for a period of time until the failure is judged to have occurred. For safety, such trouble must be prevented.

The present invention is aimed at solving such problem of the conventional system mentioned above. The object of the present invention is to enable the vehicle to travel at the minimum speed necessary (limp-home) while preventing the excessive increase of the engine output, when single failure occurs to either of the two accelerator position sensors or the two throttle position sensors.

Further object of the present invention is to prevent the excessive increase of the engine output by limiting either the absolute value and/or the increase rate of the output.

Another object of the present invention is to enable the vehicle to travel at a speed corresponding to need while preventing the excessive increase of the engine output, when single failure occurs to one of the two throttle position sensors.

Another object of the present invention is to prevent the excessive increase of the engine output more securely during single failure of the throttle position sensor.

Further object of the present invention is to prevent the stalling of the vehicle caused by unnecessary decrease of the engine output during single failure of the throttle position sensor.

SUMMARY OF THE INVENTION

In order to realize the above objects, a first fail-safe control method of an internal combustion engine with an electronic controlled throttle system according to the present invention comprises the steps of:

setting a target position of a throttle valve equipped in an intake system of the engine according to engine operating conditions including an accelerator position detected by one accelerator position sensor selected from two accelerator position sensors equipped to the engine;

operating the throttle valve to open and close by an actuator, so that the position of the throttle valve detected by one throttle position sensor selected from two throttle position sensors equipped to the engine reaches the target position; and providing a limit to the increase in accelerator opening for the output characteristics of the selected accelerator position sensor, when one sensor out of the two accelerator position sensors or the two throttle position sensors fails to operate.

Further, a first fail-safe control apparatus of an internal combustion engine with an electronic controlled throttle system according to the present invention comprises:

two accelerator position sensors for detecting an accelerator position;

a target position setting device for setting a target position of a throttle valve equipped in an intake system of the engine according to engine operating conditions including the accelerator position detected by a selected one accelerator position sensor out of the two accelerator position sensors;

two throttle position sensors for detecting a position of the throttle valve;

a throttle valve driving device for opening and closing said throttle valve by an actuator, so that the position of the throttle valve detected by one throttle position sensor selected from the two throttle position sensors reaches the target position; and an output characteristics limiting device for providing a limit to the increase in accelerator opening for the output characteristics of the selected accelerator position sensor, when one sensor out of the two accelerator position sensors or the two throttle position sensors fails to operate.

According to the first fail-safe control method or apparatus of an internal combustion engine with an electronic controlled throttle system of the present invention, when one sensor out of the two accelerator position sensors or the two throttle position sensors fails to operate, the detection value of the remaining sensor is utilized. When doing so, a limit to the increase in accelerator opening is provided for the output characteristics of the selected accelerator position sensor, so the increase in the throttle opening controlled based on the limited output characteristics will also be limited, thereby enabling the vehicle to travel at the minimum speed necessary (limp-home) while preventing the excessive increase in the engine output.

Further, the limit to the increase in accelerator opening may include a function to limit the absolute value of the accelerator position by an upper limit value.

This enables the absolute value of the accelerator position to be limited by an upper limit value, which limits the upper limit of the throttle position, and a limp-home control may be performed where the increase in the absolute speed is restrained.

Even further, the limit to the increase in accelerator opening may include a function to limit the increase change rate of the accelerator position by an upper limit change rate.

This enables the increase change rate of the accelerator position to be limited by an upper limit change rate, whereby the increase change rate of the throttle position is limited, and a limp-home control may be performed where rapid acceleration is restrained.

Even further, the limit to the increase in accelerator opening may include a function to limit the absolute value of the accelerator position by an upper limit value and a function to limit the increase change rate of the accelerator position by an upper limit change rate, and the smaller value between the accelerator position being limited by the upper limit value and the accelerator position being limited by the upper limit change rate may be selected.

Accordingly, by selecting through the output characteristics limiting device the smaller value out of the accelerator position limited of its absolute value by an upper limit value, and the accelerator position limited of its increase change rate by an upper limit change rate, the throttle valve position may be controlled according to the limited accelerator position characteristics, and a limp-home control may be performed where both rapid acceleration and increase in absolute speed are restrained.

Even further, the failure of one sensor out of the two accelerator position sensors or the two throttle position sensors may be determined when said one sensor fails to operate continuously for a predetermined time.

Accordingly, a transitional failure of the sensor may be excluded, and only continuous failure of the sensor may be determined as single failure.

Next, according to a second fail-safe control method of an internal combustion engine with an electronic controlled throttle system, said method comprises the steps of:

setting a target position of a throttle valve equipped in an intake system of the engine according to engine operating conditions including an accelerator position detected by an accelerator position sensor;

operating the throttle valve to open and close by an actuator, so that the position of the throttle valve detected by one throttle position sensor selected from the two throttle position sensors equipped to the engine reaches the target position; and setting a fuel injection quantity based on a detection value of the accelerator position and a detection value of engine rotation speed detected by an engine rotation speed detecting device, when one sensor out of the two throttle position sensors fails to operate.

Further, a second fail-safe control apparatus of an internal combustion engine with an electronic controlled throttle system according to the present invention comprises:

an accelerator position sensor for detecting an accelerator position;

a target position setting device for setting a target position of a throttle valve equipped in an intake system of the engine according to engine operating conditions including the accelerator position detected by the accelerator position sensor;

two throttle position sensors for detecting a position of said throttle valve;

a throttle valve driving device for opening and closing the throttle valve by an actuator, so that the position of the throttle valve detected by one throttle position sensor selected from the two throttle position sensors reaches the target position; and a fuel injection quantity setting device during failure for setting a fuel injection quantity based on a detection value of the accelerator position and a detection value of engine rotation speed by an engine rotation speed detecting device, when one sensor out of the two throttle position sensors fail to operate.

According to the second fail-safe control method or apparatus of an internal combustion engine with an electronic controlled throttle system of the present invention, when one of the two throttle position sensors fails to operate, the detection value of the remaining working sensor is used to feed-back control the position of the throttle valve. In this case, even if a situation occurs where the position of the throttle valve may be increased abnormally, since the fuel injection quantity is set based on the engine rotation speed and the accelerator position detected by the accelerator position sensor operated by the will of the driver, even when the intake air quantity is increased by the increase in throttle valve opening, the increase in fuel injection quantity may be restrained without depending on the increase in intake air quantity. Moreover, the excessive limitation on the engine output caused by limiting the throttle valve position to a default position and the like will not occur. Therefore, the desired engine output may be gained by setting an appropriate fuel injection quantity.

Further, when both two throttle position sensors are working normally, the fuel injection quantity may be set based on the detection value of an intake air quantity by an intake air quantity detecting device and the detection value of the engine rotation speed.

Accordingly, when both two throttle position sensors are working normally, the fuel injection quantity may be controlled to a value corresponding highly accurately to the intake air quantity, based on the detection value of the intake air quantity and the detection value of the engine rotation speed.

In a third fail-safe control method of an internal combustion engine with an electronic controlled throttle system according to the invention, said method comprises the steps of:

setting a target position of a throttle valve equipped in an intake system of the engine according to engine operating conditions including an accelerator position detected by an accelerator position sensor;

operating the throttle valve to open and close by an actuator, so that the position of the throttle valve detected by one throttle position sensor selected from two throttle position sensors equipped to the engine reaches the target position;

when one sensor out of the two throttle position sensors fails to operate, setting a first fuel injection quantity based on a detection value of the accelerator position and a detection value of an engine rotation speed, and setting a second fuel injection quantity based on a detection value of a mass intake air quantity and a detection value of the engine rotation speed, and thereafter, selecting the smaller value of the two and setting the selected value; and when both two throttle position sensors are working normally, setting the fuel injection quantity based on the detection value of the mass intake air quantity and the detection value of the engine rotation speed.

Further, a third fail-safe control apparatus of an internal combustion engine with an electronic controlled throttle system according to the present invention comprises:

an accelerator position sensor for detecting an accelerator position;

a target position setting device for setting a target position of a throttle valve equipped in an intake system of the engine according to engine operating conditions including the accelerator position detected by the accelerator position sensor;

two throttle position sensors for detecting a position of the throttle valve;

a throttle valve driving means for opening and closing said throttle valve by an actuator, so that the position of the throttle valve detected by one throttle position sensor selected from the two throttle position sensors reaches the target position; and a fuel injection quantity switching/setting device for selecting and setting the smaller value out of a fuel injection quantity set based on a detection value of the accelerator opening and a detection value of engine rotation speed by an engine rotation speed detecting device, and a fuel injection quantity set based on a detection value of a mass intake air quantity by an intake air quantity detecting device and the detection value of the engine rotation speed when one sensor out of the two throttle position sensors fails to operate, and setting the fuel injection quantity based on the detection value of the mass intake air quantity and the detection value of the engine rotation speed when both two throttle position sensors are working normally.

In the second method or apparatus of the present invention, when the air density is reduced when traveling on highland and the like during the single failure of the throttle sensor, the accelerator position will be increased, therefore, when the fuel injection quantity is set based on the accelerator position and the engine rotation speed, the fuel injection quantity may become excessive. However, according to the third method or apparatus of the present invention mentioned above, when the fuel injection quantity is set based on the detection value of the mass intake air quantity and the detection value of the engine rotation speed, the value will not be effected by the decrease in air density, and as a result, the fuel injection quantity will not be set to an excessive value. Since the smaller value of the fuel injection quantity set as above is selected, the appropriate engine output may be guaranteed.

The second and third method and apparatus may include a function to set a lower limit value of the fuel injection quantity corresponding to a lower limit value of the throttle valve position set corresponding to a failure of the throttle position sensor, when one sensor out of the two throttle position sensors fails to operate.

Accordingly, when single failure occurs during the state where the accelerator position is set too small (for example, during a released state), even though the throttle valve is set to the lower limit value (default position) corresponding to such failure of the sensor, since the accelerator position is smaller than that value, there is a possibility that the vehicle may be stalled because of the delay in the rise of the fuel injection quantity caused by the excessively low fuel injection quantity being set based on the accelerator position and the engine rotation speed,. However, by setting the lower limit value of the fuel injection quantity in correspondence to the lower limit value of the throttle valve, such stalling may be prevented, and a stable limp-home function may be secured.

Further, the second and third method and apparatus may include two accelerator position sensors, and the detection value of either one of said sensors is selected and utilized.

By comprising two accelerator position sensors and selecting the detection value from either sensor, for example, the smaller value, the method and apparatus may deal with failure or abnormality more securely.

DETAILED DESCRIPTION OF THE PREFERRED EMBODIMENT

Figure 1:
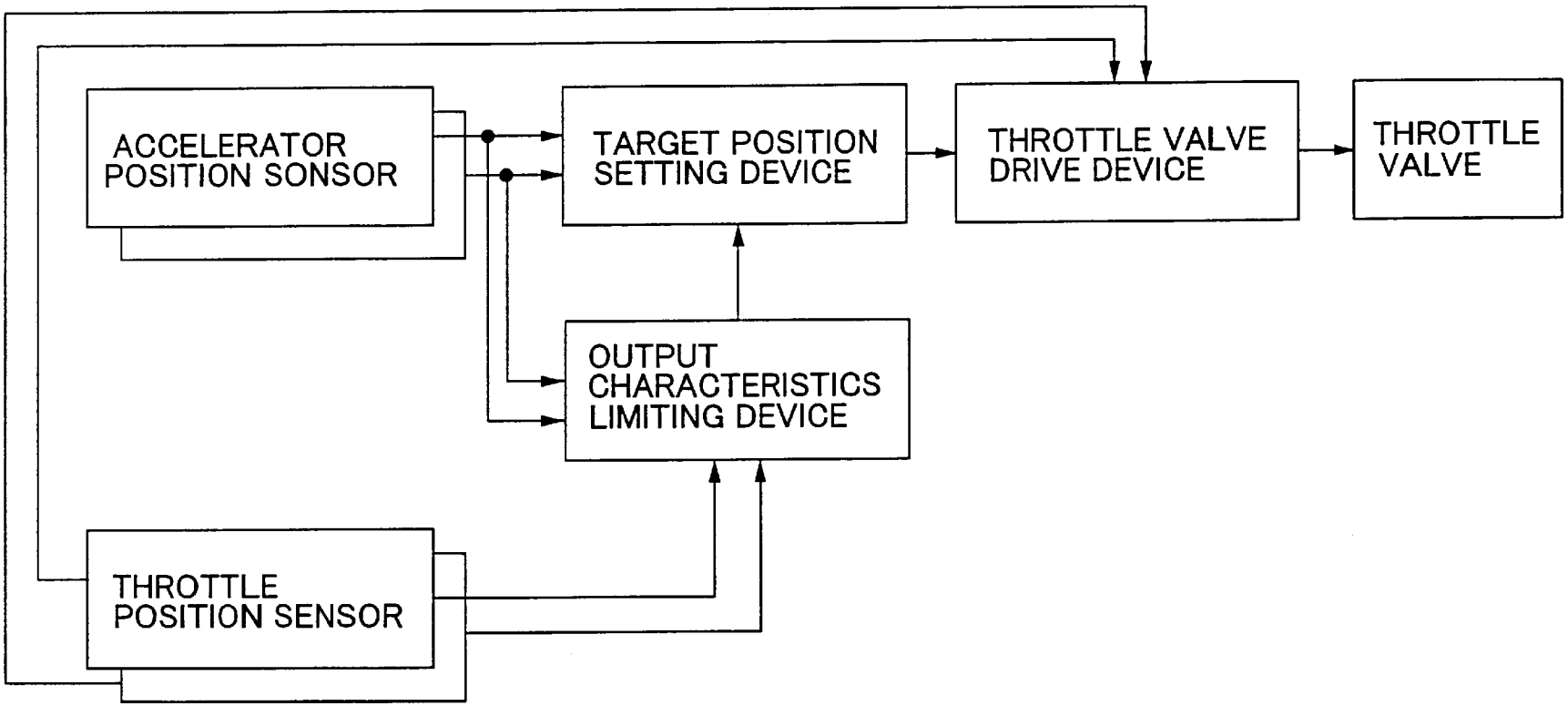
FIG. 1 is a block diagram showing the constitution and the function of a first apparatus according to the present invention.

A first apparatus for performing a fail-safe control in an internal combustion engine with an electronic controlled throttle system according to the present invention is equipped with devices shown in FIG. 1.

Two accelerator position sensors are equipped thereto, each detecting a position of the accelerator.

A target position setting device sets a target position or opening of a throttle valve mounted in an intake system according to operating conditions of the engine including the accelerator position detected by one accelerator position sensor selected from the two sensors.

Two throttle position sensors are equipped for detecting a position of the throttle valve.

A throttle valve driving device opens and closes the throttle valve by an actuator, so that the position of the throttle valve detected by one throttle position sensor selected from the two sensors reaches the target position.

An output characteristics limiting device provides a limit to the increase in accelerator opening for the output characteristics of the selected accelerator position sensor when one sensor out of the two accelerator position sensors or the two throttle position sensors mentioned above breaks down.

Figure 2:
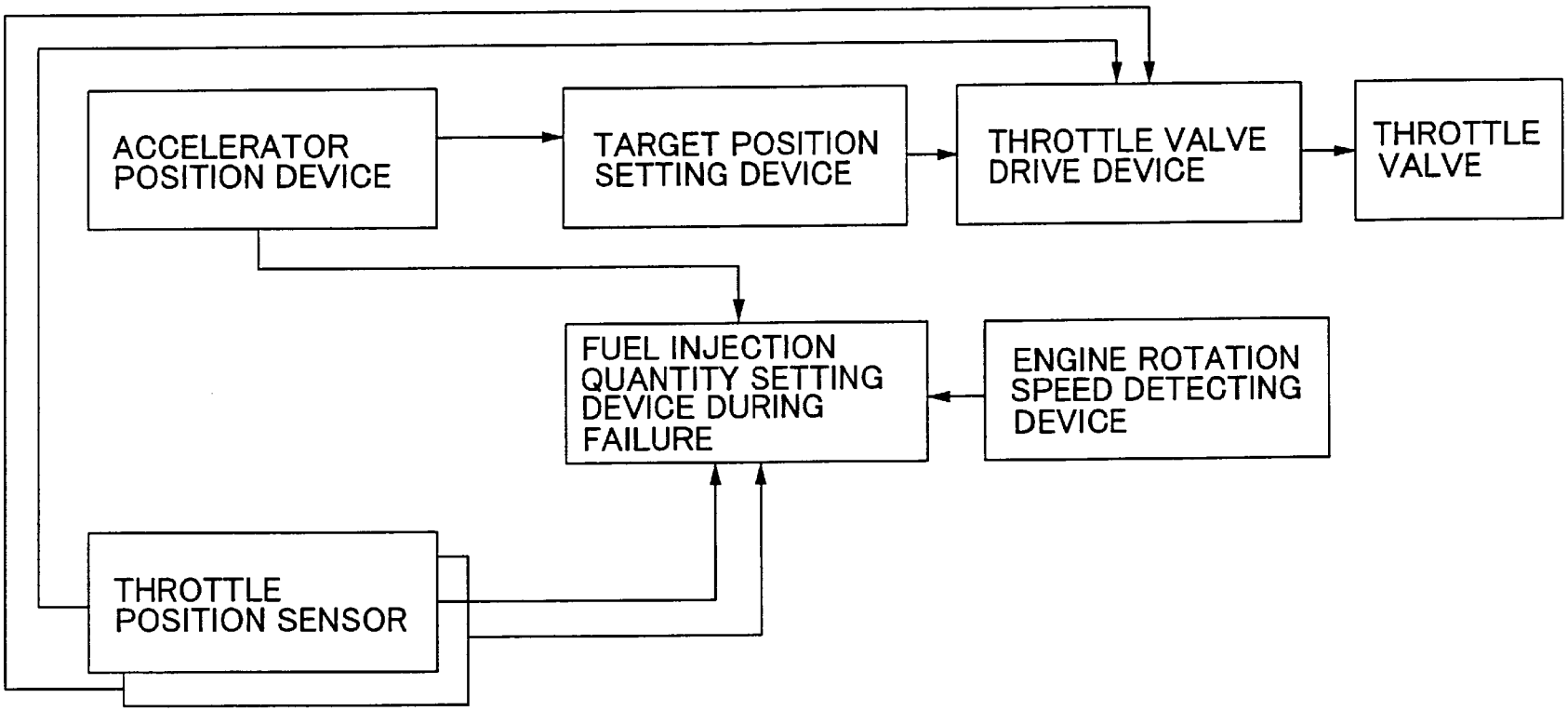
FIG. 2 is a block diagram showing the constitution and the function of a second apparatus according to the present invention.

A second apparatus for performing a fail-safe control in an internal combustion engine with an electronic controlled throttle system according to the present invention is equipped with devices shown in FIG. 2.

An accelerator position sensor detects an accelerator position.

A target position setting device sets a target position of a throttle valve equipped in an intake system, according to operating conditions of the engine including the accelerator position detected by the accelerator position sensor.

Two throttle position sensors are equipped for detecting a position of the throttle valve.

A throttle valve driving device opens and closes the throttle valve by an actuator, so that the position of the throttle valve detected by one throttle position sensor selected from the two sensors reaches the target position.

A fuel injection quantity setting device during failure is for setting a fuel injection quantity based on a detection value of the accelerator position and a detection value of engine rotation speed detected by an engine rotation speed detecting device when one of the two throttle position sensors fails to operate.

Figure 3:
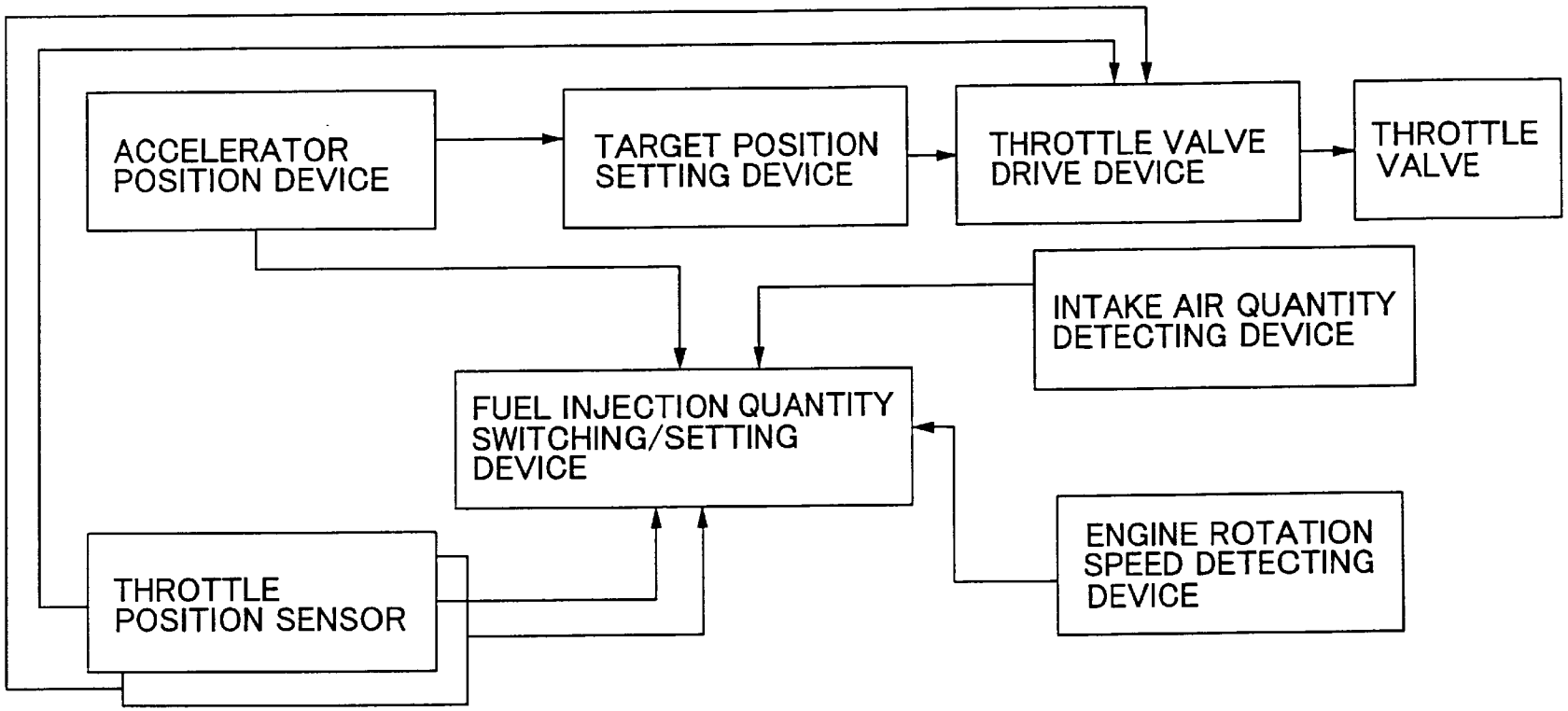
FIG. 3 is a block diagram showing the constitution and the function of a third apparatus according to the present invention.

A third apparatus for performing a fail-safe control in an internal combustion engine with an electronic controlled throttle system according to the present invention is equipped with devices shown in FIG. 3.

An accelerator position sensor detects an accelerator position.

A target position setting device sets a target position of a throttle valve equipped in an intake system according to operating conditions of the engine including the accelerator position detected by the accelerator position sensor.

Two throttle position sensors are equipped for detecting a position of the throttle valve.

A throttle valve driving device opens and closes the throttle valve by an actuator, so that the position of the throttle valve detected by one throttle position sensor selected from the two sensors reaches the target position.

When one of the two throttle position sensors fails to operate, a fuel injection quantity switching/setting device selects the smaller value of a fuel injection quantity set based on a detection value of the accelerator position and a detection value of engine rotation speed detected by an engine rotation speed detecting device, and a fuel injection quantity set based on a detection value of a mass intake air quantity detected by an intake air quantity detecting device and the detection value of the engine rotation speed. When both two throttle position sensors are operating normally, a fuel injection quantity switching/setting device sets the fuel injection quantity based on the detection value of the mass intake air quantity and the detection value of the engine rotation speed.

The embodiments of the present invention will now be explained with reference to the drawings.

Figure 4:
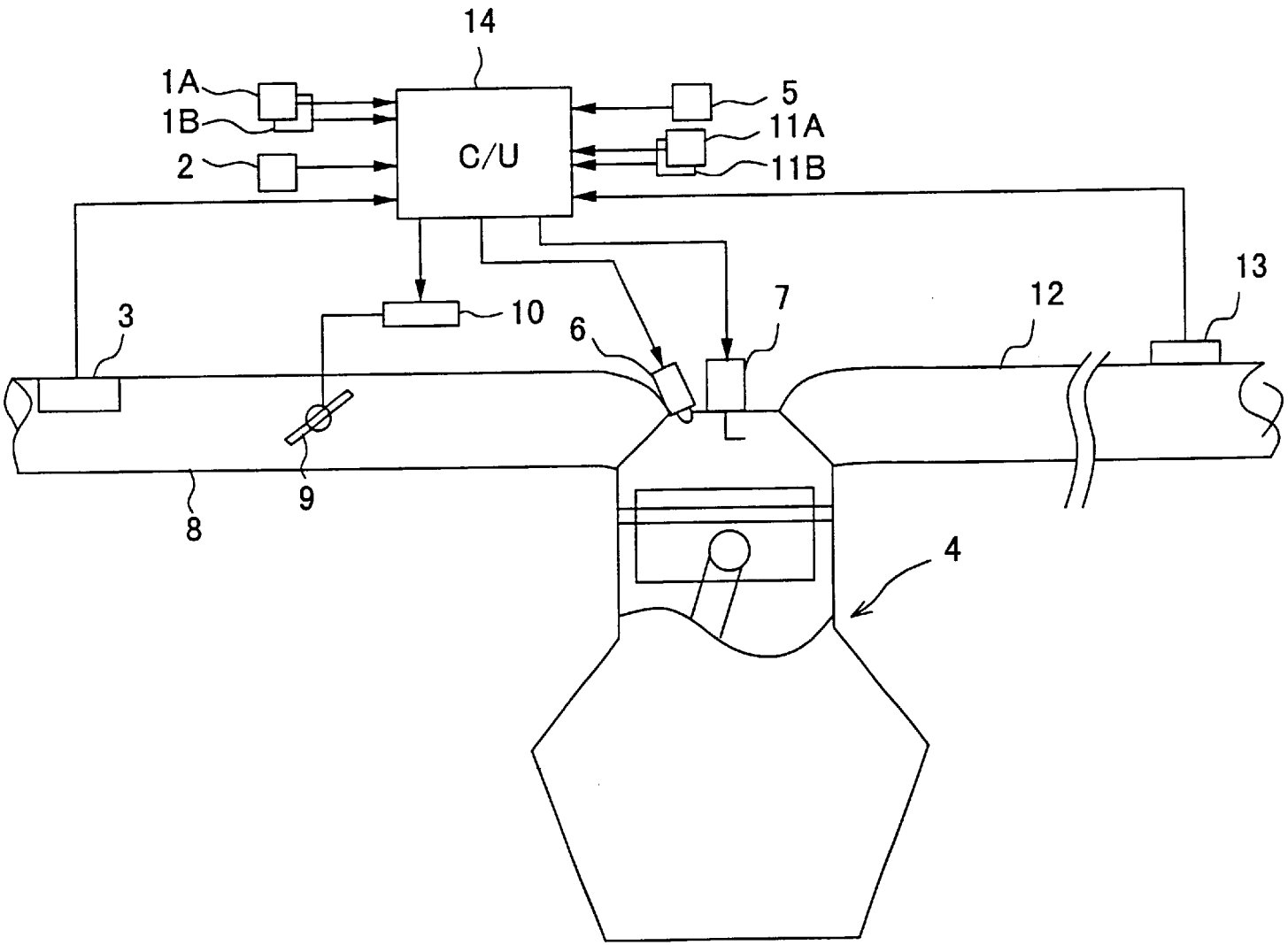
FIG. 4 is a diagram showing the system construction of an embodiment common to the first, second and third methods and apparatus according to the present invention.

FIG. 4 shows the system construction of an embodiment common to the first, second and third method and apparatus for performing the fail-safe control of an internal combustion engine with an electronic controlled throttle system according to the present invention.

Two accelerator position sensors (APS) 1A and 1B detect a step-in quantity of an accelerator pedal (accelerator position) operated by a driver.

A crank angle sensor 2 generates a reference signal for every cylinder stroke phase difference and a position signal for every unit crank angle. The engine rotation speed may be detected either by measuring the generated number of the position signals per one unit time, or by measuring the reference signal generation cycle.

An airflow meter 3 detects an intake air quantity of an engine 4 (intake air quantity per one unit time).

A water temperature sensor 5 detects the cooling water temperature of the engine.

The engine 4 is equipped with a fuel injection valve 6 driven by a fuel injection signal for injecting and supplying fuel directly into a combustion chamber, and an ignition plug 7 equipped in the combustion chamber for performing ignition. By applying the direct injection method to the combustion chamber, a stratified combustion with leaner condition may be performed, and therefore, the air-fuel ratio may be variably controlled within a relatively wide range.

Further, a throttle valve 9 is mounted in an intake passage 8 of the engine 4. An actuator 10 for electronically controlling the position of the throttle valve 9 is equipped thereto. Moreover, two throttle position sensors 11A and 11B for detecting the opening of the throttle valve 9 is equipped to the throttle valve 9.

An air-fuel ratio sensor 13 working as an air-fuel ratio detecting device for detecting an air-fuel ratio of the combustion mixture by detecting a specific component (for example, the oxygen concentration) in the exhaust, is equipped to an exhaust passage 12.

The detection signals from various sensors are input to a control unit 14. Based on the operating conditions of the engine detected based on the signals from the sensors, the control unit 14 operates the actuator 10 to control the position of the throttle valve 9, operates the fuel injection valve 6 to control the fuel injection quantity (fuel supply quantity), and sets ignition timing to control ignition of the ignition plug 7 according to the set ignition timing.

Figure 5:
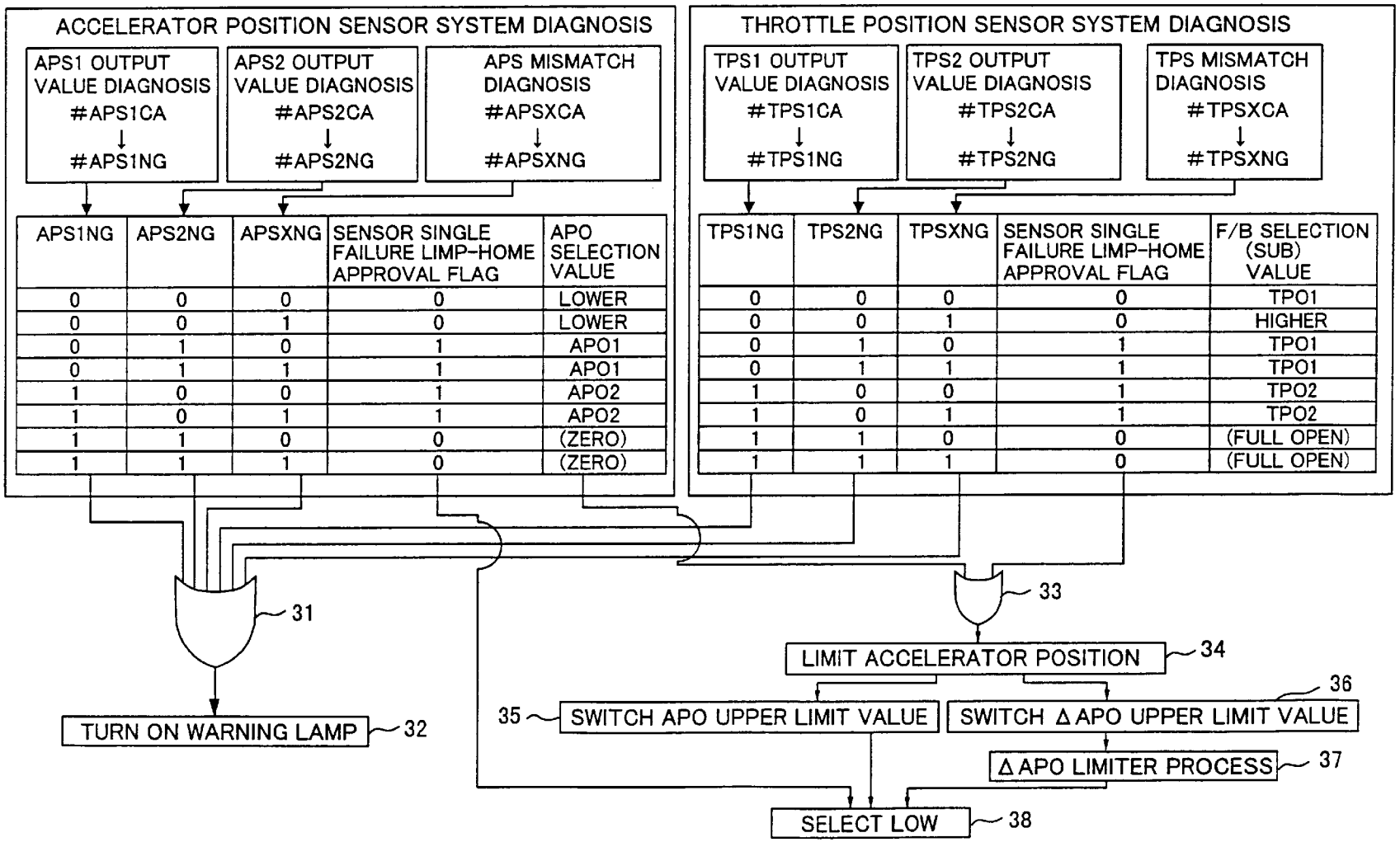
FIG. 5 is a circuit block diagram showing the throttle control based on the diagnosis of accelerator position sensor and throttle position sensor according to the embodiment of the first method and apparatus of the present invention.

Next, an embodiment on the failure diagnosis of the accelerator position sensors 1A (APS 1) and 1B (APS 2) and of the throttle position sensors 11A and 11B, and the fail-safe control (limp-home control) during failure, corresponding to the first method and apparatus according to the present invention will now be explained with reference to FIG. 5.

The accelerator position sensor system diagnosis will be explained with reference to the drawing. In the output diagnosis of the accelerator position sensor 1A and 1B, open or short failure is detected, and when the failure occurs, flags APS1CA, APS2CA is set to 1. Further, in order to eliminate transitional failure, when the failure state continues for a predetermined delay time, flags APS1NG, APS2NG are set to 1, and the failure of the accelerator position sensor 1A, 1B is determined. Further, when the flags (including the flags to be explained hereinafter) are set to 1, the output to each circuit explained below is set to a high level, and when the flags are set to 0, the output to each circuit is set to a low level.

Moreover, diagnosis is performed on whether the difference between the accelerator position sensors 1A and 1B is largely mismatching (APS mismatch diagnosis). When the value is greatly mismatching, flag APSXCA is set to 1. Also in this case, in order to eliminate transitional mismatch, when the mismatch state continues for a predetermined delay time, the flag APSXNG is set to 1, and mismatch is determined.

On the other hand, the throttle position sensor system diagnosis is performed similarly as the accelerator position sensor system diagnosis. That is, open or short failure of the throttle position sensors 11A, 11B is detected, and when failure occurs, flags TPS1CA, TPS2CA are set to 1. When the failure state continues for a predetermined delay time, flags TPS1NG, TPS2NG are set to 1, and the failure of the throttle position sensors 11A, 11B is determined. When the difference between the throttle position sensors 11A and 11B is greatly mismatching, flag TPSXCA is set to 1. When the mismatch state continues for a predetermined delay time, the flag TPSXNG is set to 1, and mismatch is determined.

As for the accelerator position sensor system, when all three flags APS1NG, APS2NG and APSXNG are 0 (first line of the chart regarding said system), that is, when all the diagnosis results of the accelerator position sensor system are normal, the lower value out of the two detection values of the accelerator position sensors 1A and 1B is selected (LOWER). As for the throttle position sensor system, when all three flags TPS1NG, TPS2NG and TPSXNG are 0 (first line of the chart regarding said system), the detection value TPO1 of one throttle position sensor 11A is selected.

When all result of the diagnosis performed in each system is normal, there is no need of performing a limp-home. Therefore, the sensor single failure limp-home approval flag is set to 0. Accordingly, when all is normal for both systems, the actuator 10 is operated, and the position of the throttle valve 9 is controlled to a target throttle position set based on the smaller accelerator position APO. In this case, the output of a first OR circuit 31 is maintained to a low level, and a warning lamp will not be turned on.

Further, when only the mismatch flag APSXCA (TPSXCA) for at least one system is set to 1 (second line of the chart regarding each system), it is determined that both values detected by the accelerator position sensors 1 A and 1 B (throttle position sensor 11A and 11B) are not reliable. The first OR circuit 31 becomes a high level, and as shown in reference numeral 32 of the drawing, the warning lamp is turned on. Similarly as the normal state, the actuator 10 is operated, and the position of the throttle valve 9 is controlled to a target throttle position set based on the smaller accelerator position APO. Further, when at least one of the six flags APS1NG, APS2NG, APSXNG, TPS1NG, TPS2NG or TPSXNG is 1, the first OR circuit 31 becomes a high level, and the warning lamp is turned on.

Next, when only one of the flags APS1NG or APS2NG (TPS1NG or TPS2NG) of each system is set to 1, that is, when only either of the accelerator position sensor 1A or 1B (throttle position sensor 11A or 11B) is diagnosed as failure (single failure) (third, fourth, fifth and sixth line of the chart regarding each system), the sensor single failure limp-home approval flag is set to 1. As for the accelerator position APO (throttle position TPO), the detection value APS1 or APS2 (TPO1 or TPO2) of the sensor diagnosed as normal is selected, but as for the accelerator position, a limit is provided to the increase in the accelerator opening according to the present invention.

Figure 6:
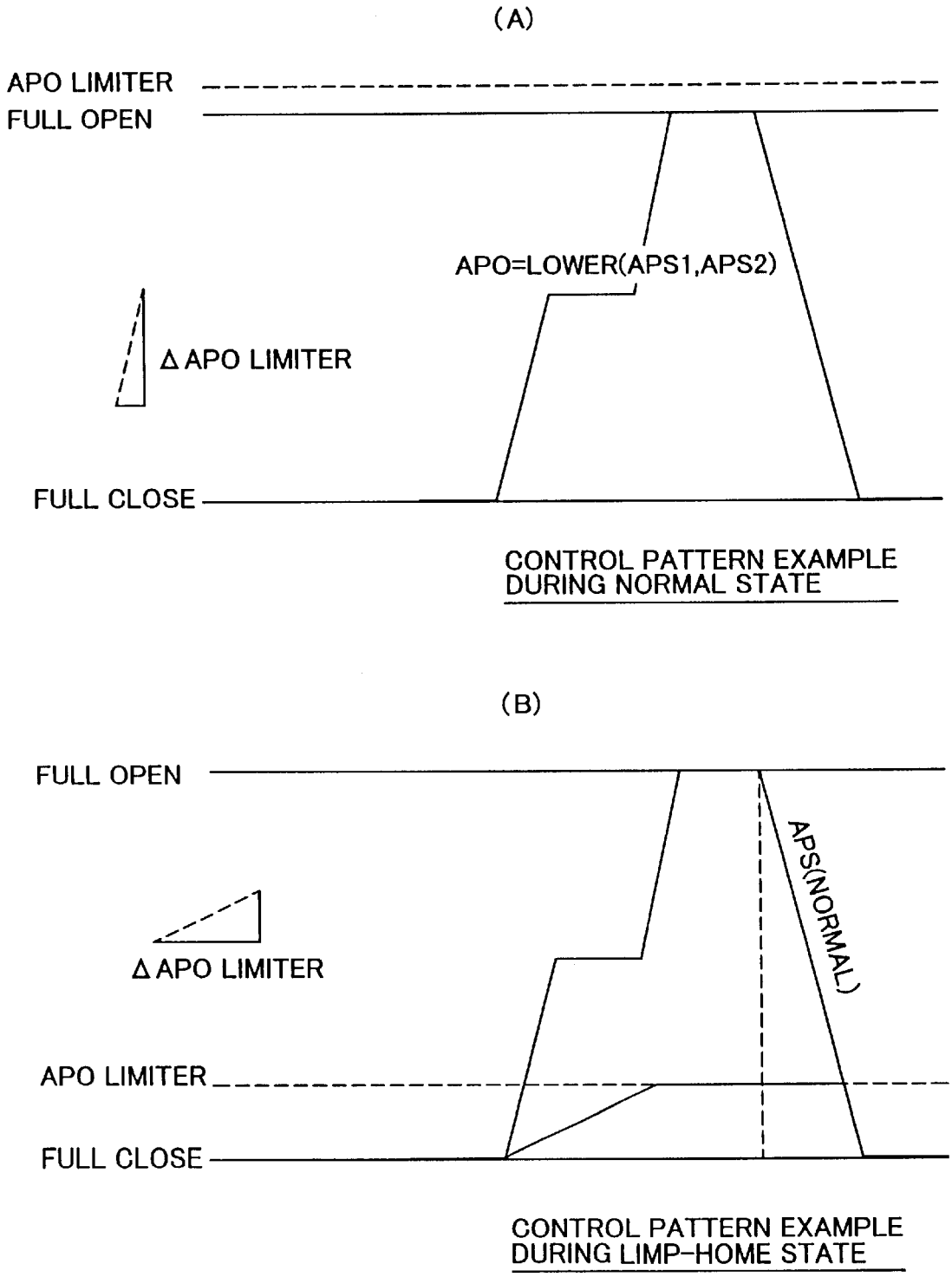
FIG. 6 is a diagram showing the accelerator position output characteristics during the normal condition of the accelerator position sensor and the throttle position sensor, and the accelerator position output characteristics during single failure, according to an embodiment of the first method and apparatus of the present invention.

That is, when single failure occurs in the accelerator position sensor 1A or 1B or the throttle position sensor 11A or 11B, the output of a second OR circuit 33 becomes a high level, and two types of limitation are added to the output characteristics of the accelerator position (reference numeral 34). One limitation is for limiting the absolute value of the accelerator position by the upper limit value, and the other limitation is for limiting the increase change rate of the accelerator position by an upper limit change rate. Actually, as shown in FIG. 6 (A), the upper limit value (APO limiter) and the upper limit change rate (ΔAPO limiter) are set during a normal state, but these values are set to sufficiently large values, such that the values should not be actually limited in a normal accelerator operation. On the other hand, the upper limit value (APO limiter) and the upper limit change rate (ΔAPO limiter) are set to smaller values during single failure. During single failure, as shown in reference numerals 35 and 36 of the drawing, the upper limit value (APO limiter) and the upper limit change rate (ΔAPO limiter) are set to be switched to the smaller values.

Further, the upper limit change rate is set as the upper limit value of the change quantity of the accelerator position per a unit time. A ΔAPO limiter process (37 in the drawing) is performed where the increase change rate, that is, the increase change quantity ΔAPO of the accelerator position detected this time and the accelerator position detected one unit time before, is compared with the upper limit change rate (ΔAPO limiter), and the smaller one is selected. By such process, the increase change rate of the accelerator position is limited to a value equal to or below the upper limit change rate.

The detection value APO from the selected accelerator position sensor 1A or 1B (during single failure of the accelerator position sensor, the detection value of the sensor diagnosed as normal), the switched/selected upper limit value (APO limiter) and the accelerator position performed of the above ΔAPO limiter process are inputted to a select low circuit 38, and the smallest accelerator position of all values is selected and used.

Accordingly, as shown by the thick continuous line of FIG. 6(B), the absolute value of the accelerator position is limited by the upper limit value (APO limiter), and the increase change rate is limited by the upper limit change rate (ΔAPO limiter). By the control of the throttle valve position corresponding to the limited accelerator position characteristics, a limp-home control may be performed where rapid acceleration is restrained and increase of absolute speed is also restrained.

Further, in a simplified system, only the absolute value of the accelerator position may be limited by the upper limit value, or only the increase change rate may be limited by the upper limit change rate.

When both two accelerator position sensors 1A and 1B (throttle position sensors 11A and 11B) fail to operate, the throttle position may not be controlled normally, so though not shown in the drawing, the power supply to the actuator is stopped, and the throttle valve 9 is maintained at a predetermined default position realized for example by the balance between a return spring and a default spring.

Next, the embodiments on the failure diagnosis of the throttle position sensors 11A and 11B and the fail-safe control during failure corresponding to the second method and apparatus according to the present invention will be explained.

Figure 7:
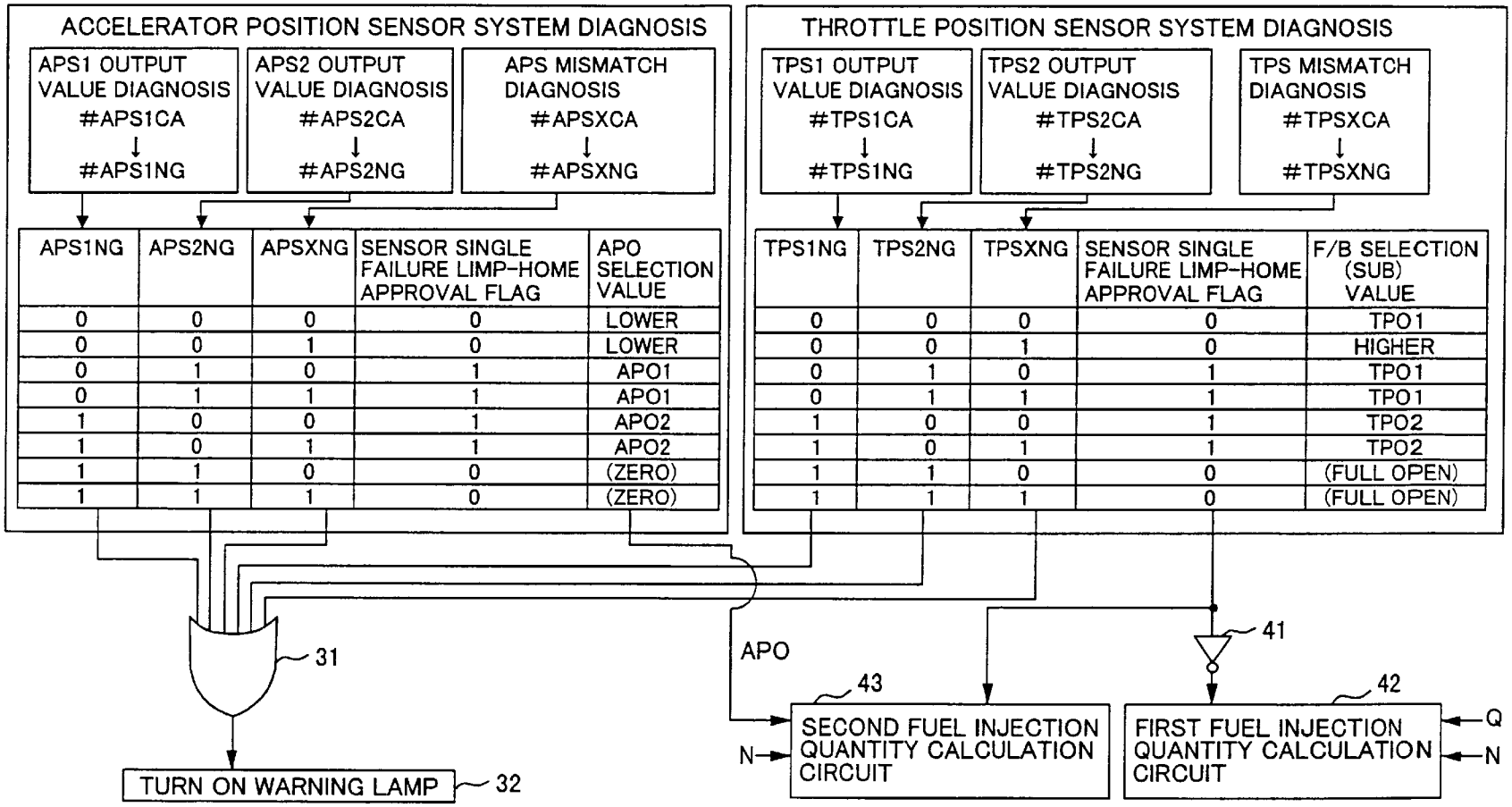
FIG. 7 is a circuit block diagram showing the throttle control based on the diagnosis of accelerator position sensor and throttle position sensor according to a first embodiment of the second method and apparatus of the present invention.

FIG. 7 shows a circuit block diagram of a first embodiment of the second method and apparatus of the present invention. The diagnosis on the accelerator position sensor system and the throttle position sensor system, and the method of setting each flags in correspondence to the diagnosis results, are the same as the embodiment of the first method and apparatus shown in FIG. 5. Also, similar to FIG.

5, the present embodiment comprises a first OR circuit 31, and when at least one of six flags APS1NG, APS2NG, APSXNG, TPS1NG, TPS2NG and TPSXNG is set to 1, the first OR circuit 31 becomes a high level, and the warning lamp is turned on.

On the other hand, according to the second method and apparatus of the present invention, during single failure of the throttle position sensor 11A or 11B, the position control of the throttle valve 9 is performed based on the detection value of the other throttle position sensor without any limitation. In this case, if, according to any cause, the detection value of the other throttle position sensor does not correspond to the accelerator position, and is increased excessively, the increase in the intake air quantity corresponding to the increase in throttle position will lead to excessive fuel injection quantity, and the engine output will be excessively increased, when applying the general method where the fuel injection quantity is set based on the engine rotation speed and the intake air quantity detected by the airflow meter. Further, even when applying the method where the fuel injection quantity is set based on the engine rotation speed and the throttle valve position, the increase in the throttle valve opening will lead to excessive increase in fuel injection quantity, and the engine output will similarly be increased excessively.

Therefore, the fuel injection quantity will be set based on the method explained below.

That is, according to the first embodiment shown in FIG. 7, when both throttle position sensors 11A and 11B are normal, that is, when the sensor single failure limp-home approval flag is reset to 0, an output of an inverter 41 will become a high level, and according to a first fuel injection quantity calculation circuit 42, based on the intake air quantity Q detected by the airflow meter 3 and the engine rotation speed N, the fuel injection quantity Tp is calculated.

Moreover, during single failure of the throttle position sensor 11A or 11B, the sensor single failure limp-home approval flag is set to 1, and according to a second fuel injection quantity calculation circuit 43, based on the detection value selected of the accelerator position sensor 1A or 1B (APO1 or APO2) and the engine rotation speed N, the fuel injection quantity Tp is calculated.

During single failure of the throttle position sensor 11A or 11B, when performing a feedback control of the position of the throttle valve 9 by utilizing the value detected by the other (remaining) sensor, there is a possibility that the opening of the throttle valve 9 may be increased abnormally.

However, even during such case, the fuel injection quantity is calculated and set based on the engine rotation speed and the accelerator position detected by the accelerator position sensor operated according to the will of the driver, the increase in fuel injection quantity may be restrained without relying on the increase in the intake air quantity, even when the intake air quantity is increased accompanying the increase in throttle valve opening. Moreover, by setting the fuel injection quantity in accordance with the will of the driver as described above, the requested output may be gained without limiting the increase in throttle valve opening and setting the fuel injection quantity in correspondence to the intake air quantity as is the case with the first method and apparatus of the present invention. Further, according to the second fuel injection quantity calculation circuit 43, when calculating the fuel injection quantity based on the accelerator position and the engine rotation speed, the target intake air quantity may be calculated based on said values before calculating the fuel injection quantity based on the intake air quantity and the engine rotation speed. Moreover, the target torque may be calculated first based on the accelerator position and the engine rotation speed, and based on the target torque and the engine rotation speed, the target intake air quantity may be calculated, and based on the target intake air quantity and the engine rotation speed, the fuel injection quantity may be calculated (the same could be said for the following embodiments).

Figure 8:
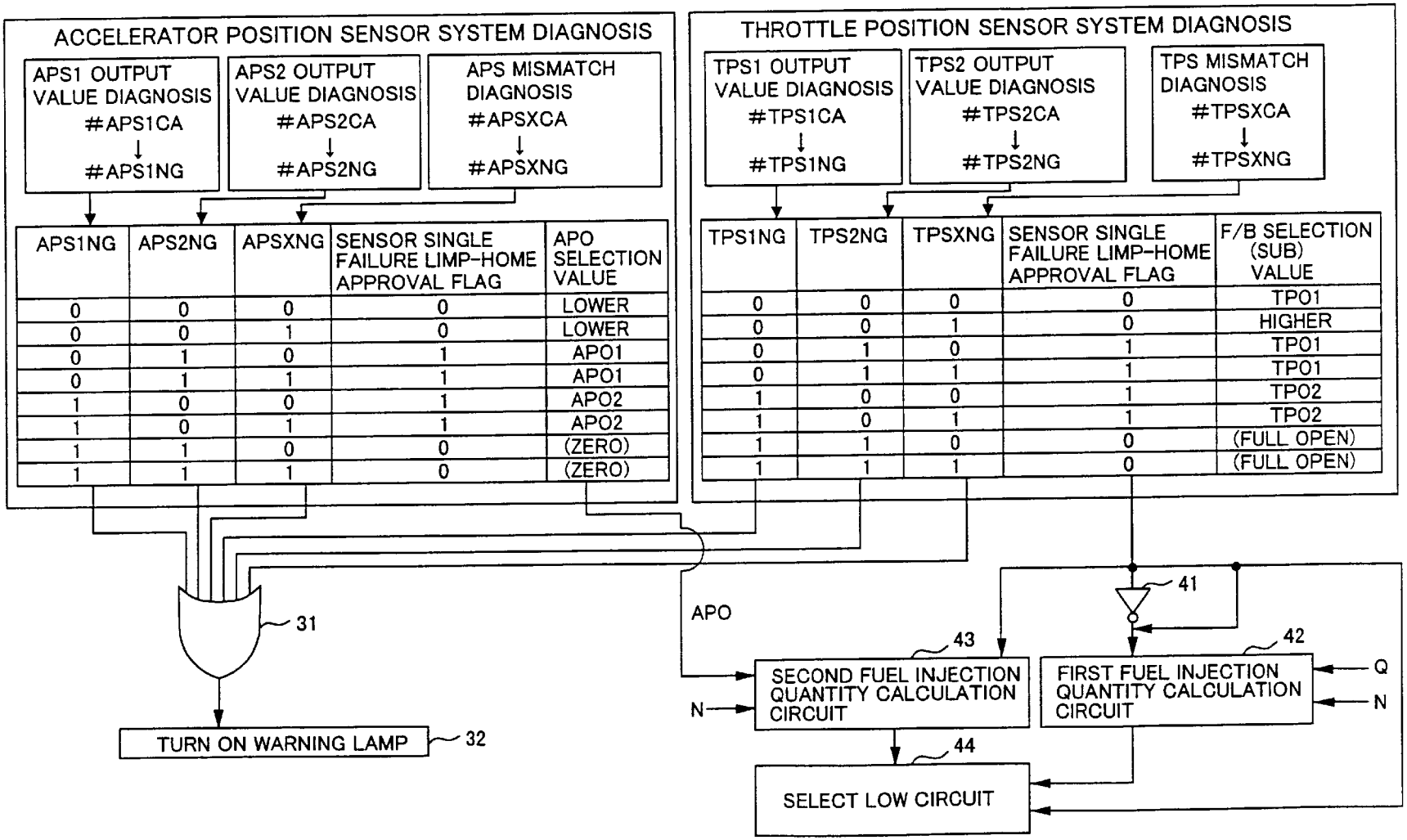
FIG. 8 is a circuit block diagram showing the throttle control based on the diagnosis of accelerator position sensor and throttle position sensor according to a second embodiment of the second method and apparatus of the present invention.

FIG. 8 shows a circuit block diagram according to a second embodiment of the second method and apparatus. The second embodiment is formed by adding a predetermined circuit to the composition of the first embodiment.

When both throttle position sensors 11A and 11B are normal, a first fuel injection quantity calculation circuit 42 calculates the fuel injection quantity Tp based on the engine rotation speed N and the intake air quantity Q detected by the airflow meter 3 through an output of an inverter 41, and the calculated value itself is used, which is similar to the first embodiment.

When single failure occurs in the throttle position sensor 11A or 11B, the sensor single failure limp-home approval flag is set to 1, and a second fuel injection quantity calculation circuit 43 calculates the fuel injection quantity Tp based on the engine rotation speed N and the selected detection value of the accelerator position sensor 1A or 1B (APO1 or APO2), which is also similar to the first embodiment. However, at the same time, in the second embodiment, the high level output of the sensor single failure limp-home approval flag is also introduced to the first fuel injection quantity calculation circuit 42, so as to calculate the fuel injection quantity Tp based on the engine rotation speed N and the intake air quantity Q at the first fuel injection quantity calculation circuit 42. According to a select low circuit 44 driven by inputting the above flag output, the smaller fuel injection quantity selected from the first fuel injection quantity Tp1 calculated by the first fuel injection quantity calculation circuit 42 and the second fuel injection quantity Tp2 calculated by the second fuel injection quantity calculation circuit 43 is utilized.

According to the embodiment, in case the air density is reduced by travelling on highland and the like during single failure of the throttle position sensor, the accelerator opening will be increased, therefore, by the calculated value of the fuel injection quantity value calculated by the second fuel injection quantity calculation circuit 43 based on the engine rotation speed and the accelerator position, the fuel injection quantity may be excessive. However, by the calculated value of the fuel injection quantity value calculated by the first fuel injection quantity calculation circuit 42 based on the detected engine rotation speed and the detected (mass) intake air quantity, the fuel injection quantity will not be calculated excessively since the value will not be influenced by the decrease in air density and the like. The select low circuit 44 will select and set the lower fuel injection quantity, so appropriate engine output may be ensured.

Figure 9:
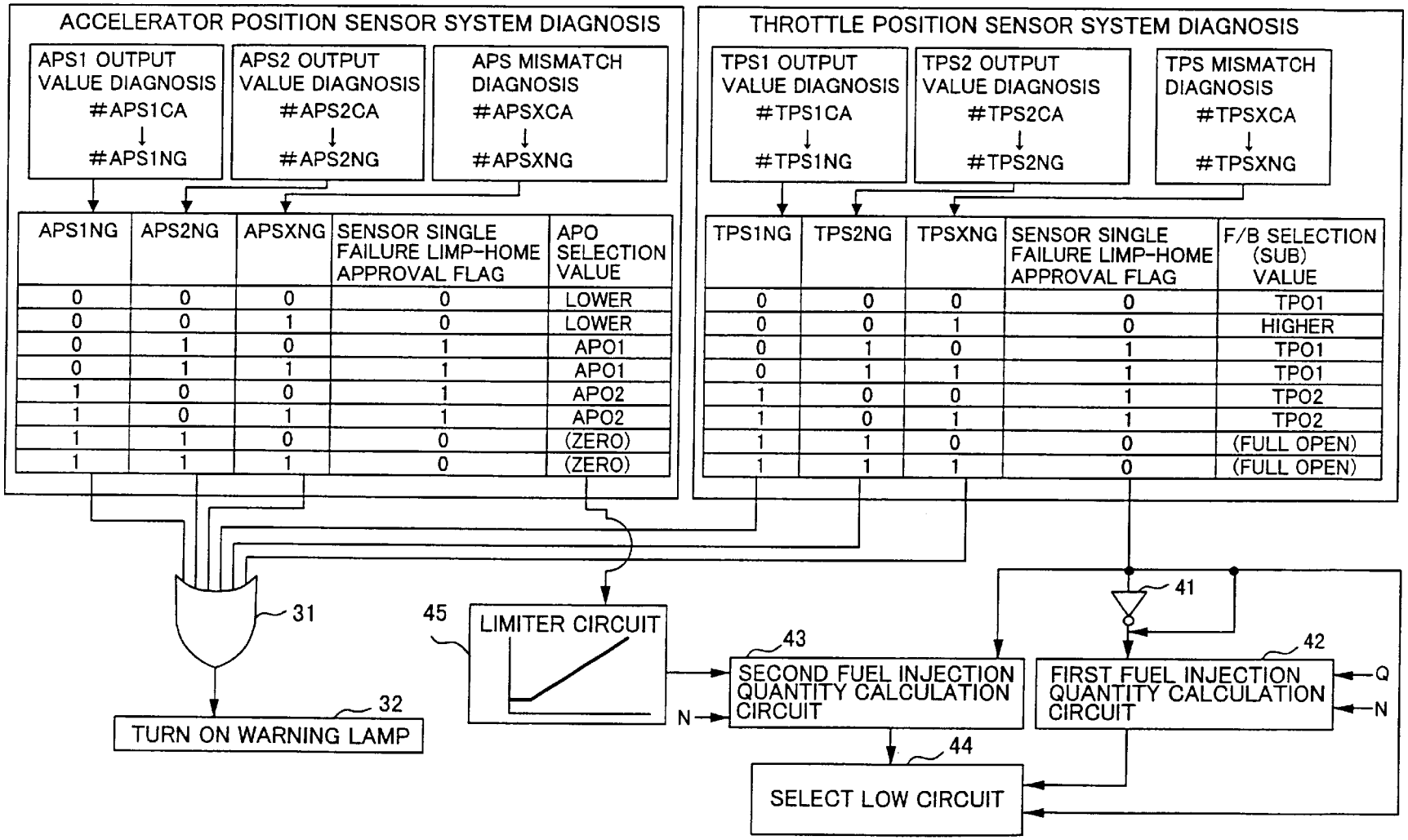
FIG. 9 is a circuit block diagram showing the throttle control based on the diagnosis of accelerator position sensor and throttle position sensor according to a third embodiment of the second method and apparatus of the present invention.

FIG. 9 shows a circuit block diagram according to a third embodiment of the second method and apparatus.

The third embodiment is formed by adding a predetermined circuit to the composition of the second embodiment.

That is, the output of the accelerator position APO is input to a second fuel injection quantity calculation circuit 43 through a lower value limiter circuit 45. When failure occurs in the throttle position sensor, a lower limit value (default position) is set to the position of the throttle valve 9, and even when the accelerator opening is smaller than the value corresponding to the default position, the throttle valve 9 is maintained at the default position. The lower value limiter circuit 45 sets the lower limit value of the accelerator position to a value corresponding to the default position, and the accelerator position APO is limited to a value equal to or above the lower limit value.

Accordingly, even when the actual accelerator position is smaller than the value corresponding to the default position, the second fuel injection quantity calculation circuit 43 uses the value corresponding to the default position value as the accelerator position when calculating the fuel injection quantity, so the fuel injection quantity corresponding to the default position will be calculated. This prevents the select low circuit 44 from selecting a fuel injection quantity that is too small corresponding to the actual accelerator position. As a result, stalling may be prevented.

Of course, the lower value limiter 45 may also be added to, in the simplified first embodiment of the present invention shown in FIG. 7, before the first fuel injection quantity calculation circuit 43.

What we claimed are:

1. A fail-safe control method of an internal combustion engine with an electronic controlled throttle system, said method comprising the steps of:

setting a target position of a throttle valve equipped in an intake system of said engine according to engine operating conditions including an accelerator position detected by one accelerator position sensor selected from two accelerator position sensors equipped to said engine;

operating said throttle valve to open and close by an actuator, so that the position of said throttle valve detected by one throttle position sensor selected from two throttle position sensors equipped to said engine reaches said target position; and limiting an increase change rate of said accelerator position detected by said selected accelerator position sensor by an upper limit change rate, when one sensor out of said two accelerator position sensors or said two throttle position sensors fails to operate.

2. A fail-safe control internal of an internal combustion engine with an electronic controlled throttle system according to claim 1, wherein the absolute value of accelerator position detected by said selected accelerator position sensor is limited by an upper limit value, and the smaller value between the accelerator position being limited by said upper limit value and the accelerator position being limited by said upper limit change rate is selected.

3. A fail-safe control method of an internal combustion engine with an electronic controlled throttle system according to claim 1, wherein the failure of one sensor out of two accelerator position sensors or two throttle position sensors is determined when said one sensor fails to operate continuously for a predetermined time.

4. A fail-safe control apparatus of an internal combustion engine with an electronic controlled throttle system comprising:

two accelerator position sensors for detecting an accelerator position;

a target position setting means for setting a target position of a throttle valve equipped in an intake system of said engine according to engine operating conditions including said accelerator position detected by one accelerator position sensor selected from said two accelerator position sensors;

two throttle position sensors for detecting a position of said throttle valve;

a throttle valve driving means for opening and closing said throttle valve by an actuator, so that the position of said throttle valve detected by one throttle position sensor selected from said two throttle position sensors reaches said target position; and an output characteristics limiting means for limiting an increase change rate of said accelerator position detected by said selected accelerator position sensor by an upper limit change rate, when one sensor our of said two accelerator position sensors or said two throttle position sensors fails to operate.

5. A fail-safe control apparatus of an internal combustion engine with an electronic controlled throttle system according to claim 4, wherein said output characteristics limiting means includes a function to limit the absolute value of said accelerator position by an upper limit value, and selects the smaller value between the accelerator position being limited by said upper limit value and the accelerator position being limited by said upper limit change rate.

6. A fail-safe control apparatus of an internal combustion engine with an electronic controlled throttle system according to claim 4, wherein the failure of one sensor out of two accelerator position sensors or two throttle position sensors is determined when said one sensor fails to operate continuously for a predetermined time.

* * * * *